US010182646B2

(12) United States Patent
Jeanty et al.

(10) Patent No.: US 10,182,646 B2
(45) Date of Patent: Jan. 22, 2019

(54) MULTIFUNCTIONAL BOTTLE WASHING BRUSH

(71) Applicants: Leif Jeanty, Miami, FL (US); Emmanuel Jeanty, Miami, FL (US)

(72) Inventors: Leif Jeanty, Miami, FL (US); Emmanuel Jeanty, Miami, FL (US)

( * ) Notice: Subject to any disclaimer, the term of this patent is extended or adjusted under 35 U.S.C. 154(b) by 175 days.

(21) Appl. No.: 15/424,131

(22) Filed: Feb. 3, 2017

(65) Prior Publication Data

US 2017/0215577 A1 Aug. 3, 2017

Related U.S. Application Data

(60) Provisional application No. 62/290,522, filed on Feb. 3, 2016.

(51) Int. Cl.
*A46B 17/06* (2006.01)
*A46B 15/00* (2006.01)
*A47L 17/04* (2006.01)

(52) U.S. Cl.
CPC ..... *A46B 17/065* (2013.01); *A46B 15/0034* (2013.01); *A47L 17/04* (2013.01); *A46B 2200/3006* (2013.01)

(58) Field of Classification Search
CPC ..... A46B 9/005; A46B 11/002; A46B 11/08; A46B 13/001; A46B 13/04; A46B 15/0034; A46B 17/065; A46B 2200/3006; A47L 17/04; A47L 17/08; A61L 2/10
See application file for complete search history.

(56) References Cited

U.S. PATENT DOCUMENTS 6,146,040 A * 11/2000 Dunn ..... A46B 11/002 401/123
7,260,862 B1 * 8/2007 DeFilippis ..... A46B 5/0095 15/22.1
7,484,260 B2 * 2/2009 Jaffe ..... A46B 11/0013 15/21.1
7,884,336 B2 * 2/2011 Gibson ..... A47L 13/17 15/104.93
8,122,554 B2 * 2/2012 Schemmel ..... A47L 13/26 15/24
9,603,689 B2 * 3/2017 Nazeri ..... A61C 17/26
9,622,629 B1 * 4/2017 Brittain ..... A47K 11/10
9,681,744 B2 * 6/2017 Russell ..... A46B 15/0002
9,808,646 B2 * 11/2017 Piergallini ..... A61C 19/063
9,839,707 B2 * 12/2017 Won ..... A61L 2/10
(Continued)

*Primary Examiner* — Jennifer C Chiang
*Assistant Examiner* — Bradley Oliver

(57) ABSTRACT

A multifunctional bottle washing brush includes a sponge, a plurality of bristles, a handle, an extension stem, an ultraviolet (UV) sterilizer light, and actuatable soap-dispensing mechanism, and a motor. The sponge, the plurality of bristles, the extension stem, and the UV sterilizer light complete an interchangeable brush that removably and terminally mounted to the handle through a rotor of the motor. The actuatable soap-dispensing mechanism that is integrated into the handle is in fluid communication with the sponge to supply a flow of soap while the interchangeable brush is rotatably operated through the motor via a power switch. Resultantly, the multifunctional bottle washing brush is able to efficiently clean dishes while the UV sterilizer light disinfects the sponge and the plurality of bristles.

13 Claims, 9 Drawing Sheets

(56) References Cited

U.S. PATENT DOCUMENTS

| | | | | |
|---|---|---|---|---|
| 2006/0255291 | A1* | 11/2006 | Harris | A61L 2/10 250/455.11 |
| 2007/0075268 | A1* | 4/2007 | Harris | A61L 2/10 250/455.11 |
| 2008/0073595 | A1* | 3/2008 | Thiruppathi | A47L 13/12 250/504 R |
| 2009/0256085 | A1* | 10/2009 | Thiruppathi | A61L 2/10 250/492.1 |
| 2011/0289717 | A1* | 12/2011 | Dhanvanthari | A46B 13/001 15/322 |
| 2011/0309268 | A1* | 12/2011 | Parker | A46B 7/04 250/492.1 |
| 2013/0008461 | A1* | 1/2013 | Wang | A45D 1/04 132/229 |
| 2014/0013529 | A1* | 1/2014 | Kilgore | A46B 9/005 15/106 |
| 2015/0069263 | A1* | 3/2015 | Moyal | A61L 2/10 250/455.11 |
| 2017/0265636 | A1* | 9/2017 | Hanneken | A46B 5/00 |
| 2018/0035861 | A1* | 2/2018 | Humphrey | A47L 17/04 |
| 2018/0049533 | A1* | 2/2018 | Tang | A46B 15/003 |
| 2018/0177381 | A1* | 6/2018 | Garcia | A47L 17/04 |
| 2018/0235354 | A1* | 8/2018 | Lee | A46B 5/0095 |

* cited by examiner

MULTIFUNCTIONAL BOTTLE WASHING BRUSH

The current application claims a priority to the U.S. Provisional Patent application Ser. No. 62/290,522 filed on Feb. 3, 2016.

FIELD OF THE INVENTION

The present invention relates generally to a bottle washing accessory. More specifically, the present invention combines a soap dispenser unit, a rotating brush, a rotating sponge, and an Ultraviolet (UV) sterilizer light into a multifunctional bottle washing brush. The soap dispensing unit, the rotating brush, and the rotating sponge allow users to effectively clean bottles or other dishes. The UV sterilizer light is used to disinfect the bottle while washing and when the present invention is not utilized by users, the UV sterilizer light disinfects the rotating brush and the rotating sponge.

BACKGROUND OF THE INVENTION

Generally, a sponge is used as a bottle washing accessory since the sponge can efficiently absorb water and water-based solution during the bottle washing process. Additionally, users can also use a bottle washing brush during the bottle washing process when the sponge is not sufficient enough. One of the problem with the sponge or the bottle washing brush is that the users have pour bottle washing liquid into the respective bottle washing accessory at the beginning and during the bottle washing process. Resultantly, the users have to periodically stop the bottle washing process so that bottle washing liquid can be poured into the respective bottle washing accessory, adding extra time to the bottle washing process and wetting users' hands. Another problem with the sponge or the bottle washing brush is that they can harbor disease-causing bacteria, fungi, and food-borne pathogens compromising the functionality of the sponge or the bottle washing brush.

It is an objective of the present invention to provide a multifunctional bottle washing brush that overcomes all of the limitations and non-effectiveness of aforementioned bottle washing accessories currently available. More specifically, the present invention comprises a soap dispenser, a rotating brush, a rotating sponge, and an Ultraviolet (UV) sterilizer light. The present invention keeps users' hands clean while cleaning bottles or other dishes which may need cleaning through the functionality of the soap dispenser, the rotating brush, and the rotating sponge. Additionally, the present invention sterilizes the rotating brush and the rotating sponge by the UV sterilizer light, which disinfects disease-causing bacteria or food-borne pathogens often carried by more traditional bottle washing accessories, while docked in a charging station. As a result, the present invention is able to provide an improved bottle washing accessory that efficiently and effectively cleans bottles or other dishes while providing a self-sterilization to eliminate disease-causing bacteria, fungi, and food-borne pathogens.

DETAIL DESCRIPTIONS OF THE INVENTION

Figure 1:
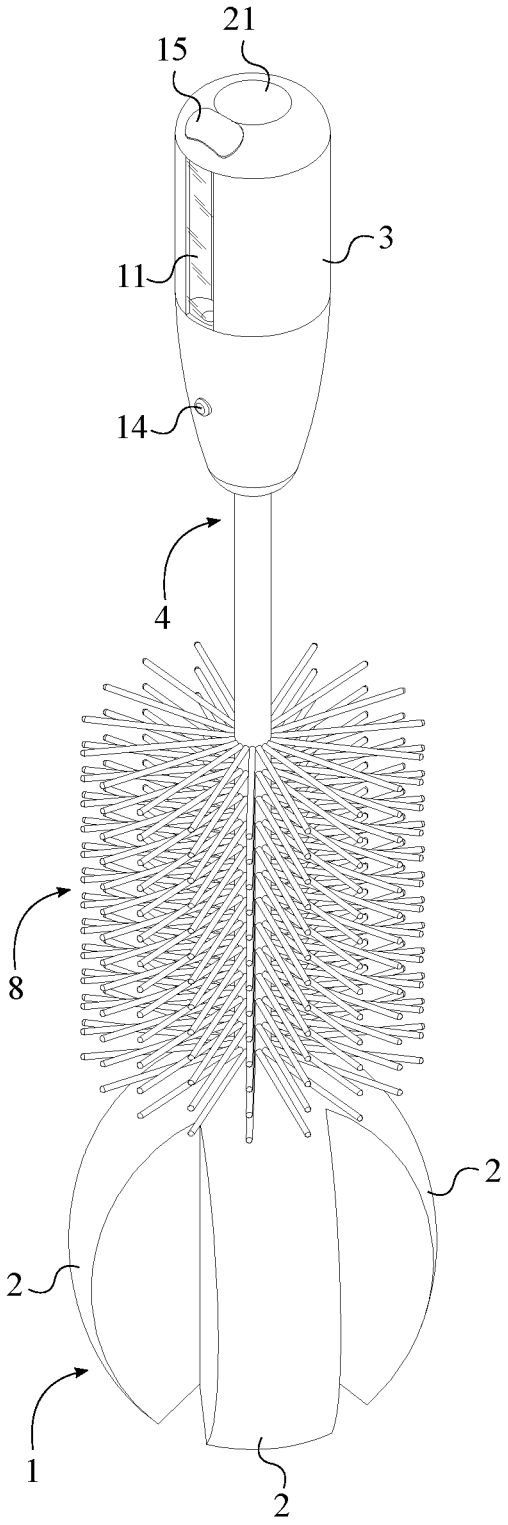
FIG. 1 is a top perspective view of the present invention without the reflective lid.
Figure 2:
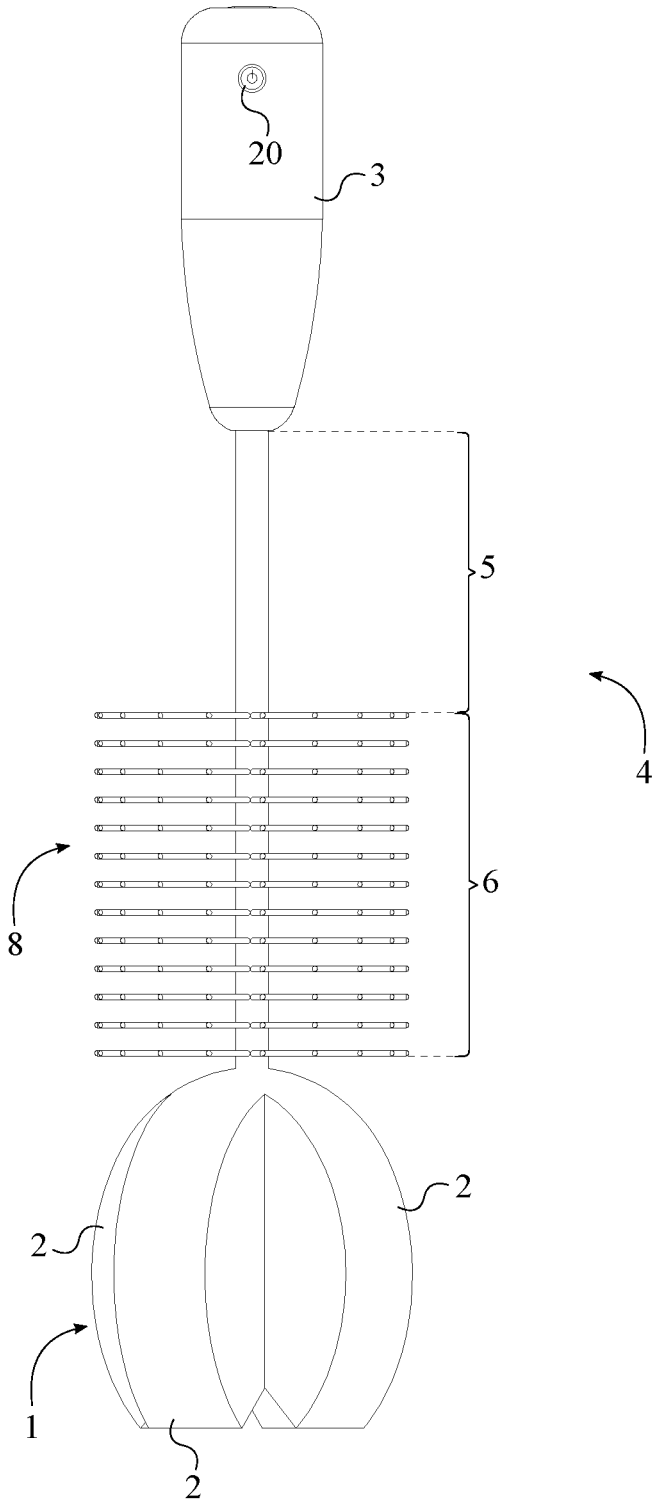
FIG. 2 is a side perspective view of the present invention without the reflective lid.
Figure 3:
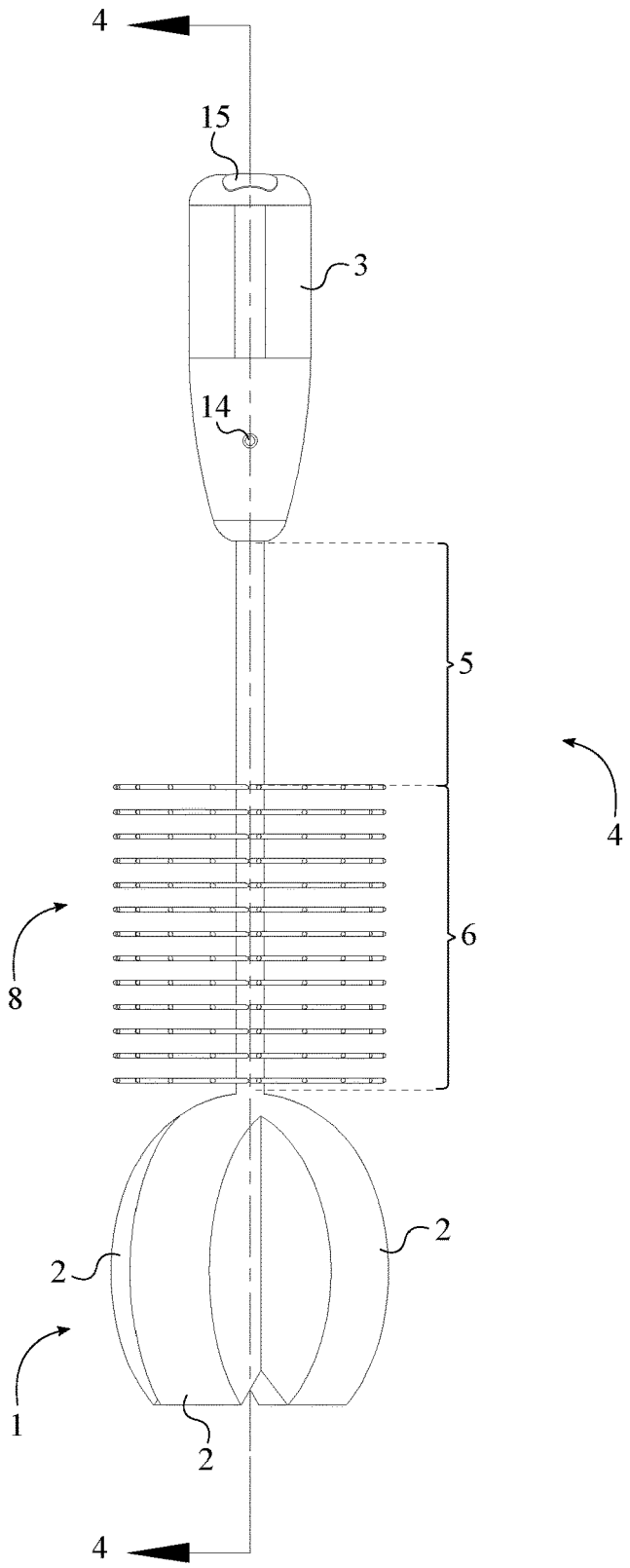
FIG. 3 is a side view of the present invention without the reflective lid, showing the plane upon which a cross sectional view is taken shown in FIG. 4.
Figure 4:
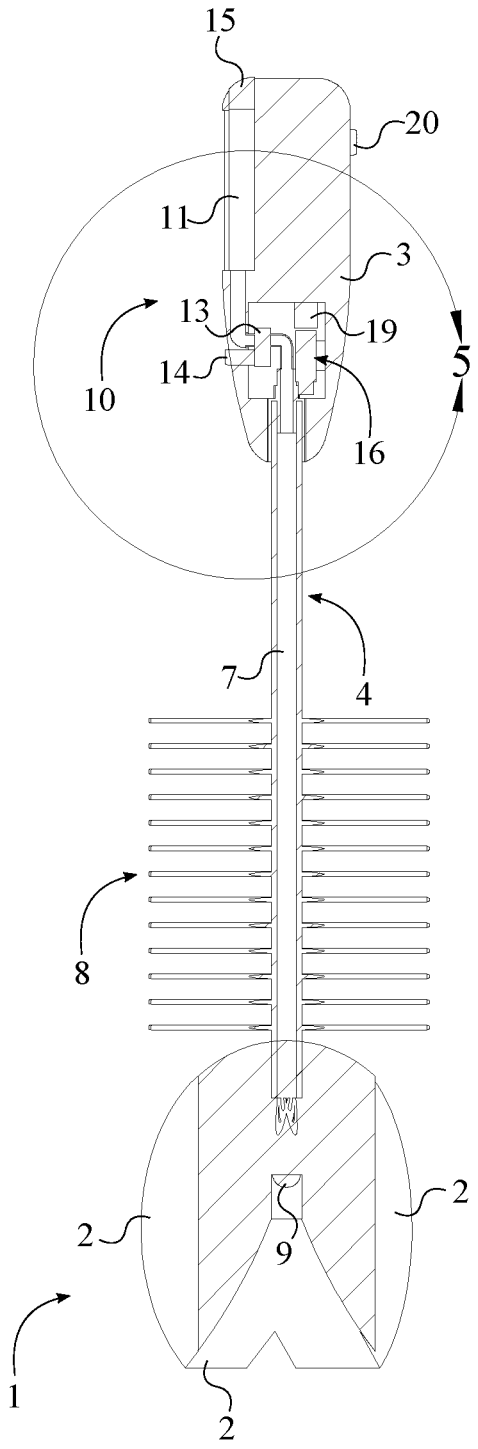
FIG. 4 is a cross section view of the present invention without the reflective lid.

All illustrations of the drawings are for the purpose of describing selected versions of the present invention and are not intended to limit the scope of the present invention.

The present invention is a multifunctional bottle washing brush. More specifically, the present invention efficiently cleans bottle or other dishes through a motorized brush while allowing an ultraviolet (UV) lighting apparatus to disinfect and sterilize the motorized brush, eliminating disease-causing bacteria or food-borne pathogens often carried by more traditional bottle washing accessories. The present invention comprises a sponge 1, a plurality of bristles 8, a handle 3, an extension stem 4, a UV sterilizer light 9, an actuatable soap-dispensing mechanism 10, and a motor 16 as shown in FIG. 1-FIG. 4. In reference to general configuration of the present invention, the sponge 1 is terminally connected to the extension stem 4. A stator 17 of the motor 16 is mounted within the handle 3 as a rotor 18 of the motor 16 terminally and removably mounts the extension stem 4 to the handle 3. The sponge 1 and the handle 3 are positioned opposite of each other along the extension stem 4 as the plurality of bristles 8 is laterally connected to the extension stem 4 in between the handle 3 and the sponge 1. As a result, the motor 16 is able to selectively operate and rotate the extension stem 4 along with the sponge 1 and the plurality of bristles 8 within the present invention. The actuatable soap-dispensing mechanism 10 is integrated into the handle 3 and is in fluid communication with the sponge 1 through the extension stem 4. Thus, the actuatable soap-dispensing mechanism 10 is able to selectively supply a flow of soap to the sponge 1. The UV sterilizer light 9 is mounted within the sponge 1 and powered through a charging station when the present invention is not utilized to clean bottles or other dishes and placed within the charging station. The UV sterilizer light 9 provides a self-sterilization process to eliminate disease-causing bacteria, fungi, and food-borne pathogens that may present within the sponge 1 and the plurality of bristles 8.

The handle 3 provides a gripping surface area for the present invention and functions as a base structure so that multitude of components for the present invention can be secured. The exterior surface of the handle 3 is formed into an ergonomic shape to minimize fatigue and discomfort that the users may encounter during the usage of the present invention. The handle 3 is preferably made of hard plastic or any other similar material so that other associated components of the present invention can be structurally connected to the handle 3 while eliminating water penetration into the handle 3.

Figure 5:
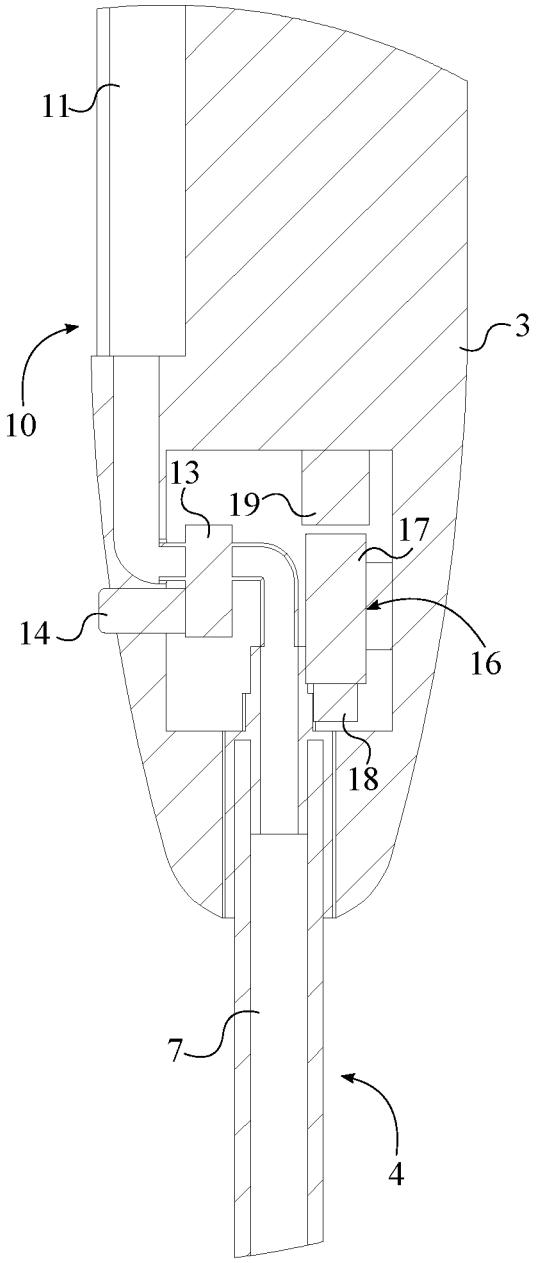
FIG. 5 is a detail view showing internal components for the handle of the present invention.
Figure 7:
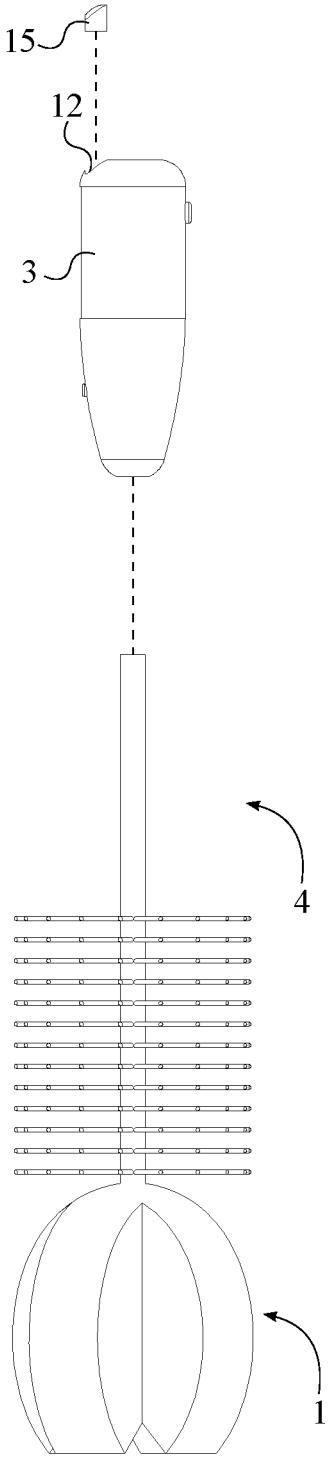
FIG. 7 is an exploded view of the present invention without the reflective lid.

The actuatable soap-dispensing mechanism 10 stores and distributes a flow of soap within the present invention. In reference to FIG. 4 and FIG. 5, the actuatable soap-dispensing mechanism 10 comprises a soap receptacle 11, a pump-valve 13, and a pump-button 14. The soap receptacle 11, which traverses into the handle 3, stores a quantity of soap within the present invention so that the users can selectively discharge a flow of soap when necessary. The soap receptacle 11 is made of transparent material so that the users can visually view the current level for the quantity of soap within the soap receptacle 11 as shown in FIG. 1. Since the soap receptacle 11 is traversed into the handle 3 from the exterior surface of the handle 3, a cap 15 is required to contain the quantity of soap within the soap receptacle 11. More specifically, as shown in FIG. 7, the cap 15 is adjacently attached about an opening rim 12 of the soap receptacle 11 so that the users can detach the cap 15 and refill the soap receptacle 11 when necessary. The pump-valve 13 is mounted within the handle 3, and the pump-button 14 is integrated onto the handle 3. More specifically, the pump-button 14 is operatively coupled with the pump-valve 13 to actuate the pump-valve 13 that is in fluid communication with the soap receptacle 11. Additionally, the pump-button 14 is preferably integrated within a thumb reach zone so that the users can easily access the pump-button 14 while the palm of the user secures the handle 3. As a result, the users can selectively discharge a flow of soap from the soap receptacle 11 into the sponge 1 through the pump-valve 13 and the extension stem 4 as the pump-valve 13 is operated by the pump-button 14.

Figure 9:
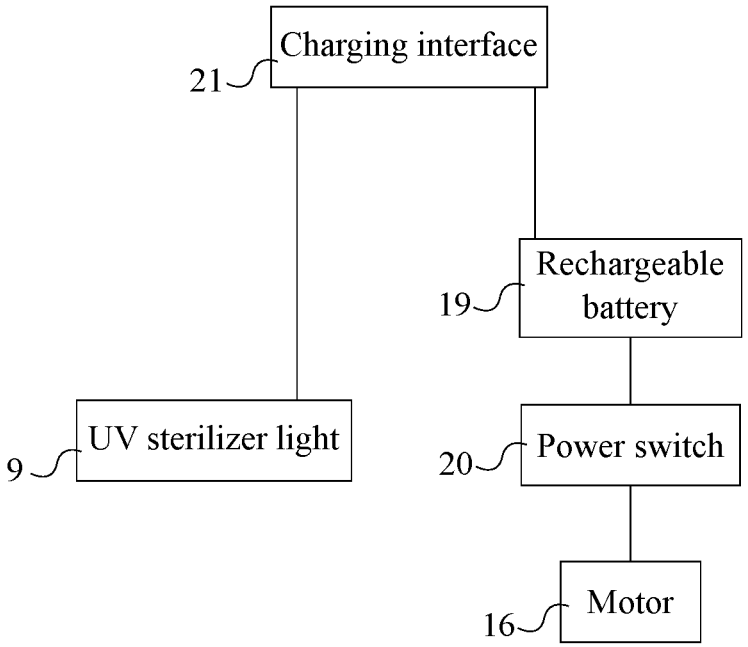
FIG. 9 is a basic schematic showing the electrical connections of the present invention.

The present invention further comprises a rechargeable battery 19, a power switch 20, and a charging interface 21 so that the motor 16 can be powered and operated within the present invention. In reference to FIG. 4 and FIG. 5, the rechargeable battery 19 is mounted within the handle 3 as electrode materials and electrolytes of the rechargeable battery 19 can include, but is not limited, lead-acid, nickel-cadmium, nickel metal hydride, lithium ion, and lithium ion polymer. In reference to FIG. 2 and FIG. 4, the power switch 20, preferably a pushbutton switch, is integrated onto the handle 3 so that the users can easily operate the power switch 20 during the usage of the present invention. More specifically, the power switch 20 is preferably integrated outside of a thumb reach zone so that the power switch 20 does not interfere with the operation of the pump-button 14 during the usage of the present invention. In reference to FIG. 9, the power switch 20 and the rechargeable battery 19 are electrically connected to motor 16 within the handle 3 so that the power switch 20 can selectively operate the motor 16 as the rechargeable battery 19 electrically powers the motor 16 through the power switch 20. In reference to FIG. 1 and FIG. 9, the charging interface 21 is integrated onto the handle 3, preferably to a bottom end of the handle 3, and electrically connected to the rechargeable battery 19. As a result, when the present invention is placed within the charging station, the charging interface 21 can electrically connect with the charging station to re-charge the rechargeable battery 19 and to power the UV sterilizer light 9.

The extension stem 4 provides the necessary length between the handle 3 and the sponge 1 so that the present invention can accommodate different bottle depths while facilitating the functionality of the present invention. The extension stem 4 is preferably made of hard plastic or any other similar material so that other associated components of the present invention can be structurally connected to the extension stem 4 while eliminating water penetration into the extension stem 4. In reference to FIG. 2-4, the extension stem 4 comprises a first section 5, a second section 6, and a stem channel 7. The first section 5 and the second section 6 are concentrically positioned adjacent to each other, and the stem channel 7 traverses through the extension stem 4. In other words, the stem channel 7 traverses through the first section 5 and the second section 6, wherein the stem channel 7 is a continues opening. The plurality of bristles 8 is laterally connected along the second section 6 and radially distributed about the second section 6 so that the plurality of bristles 8 can function as the secondary cleaning accessory within the present invention. The sponge 1 is terminally connected to the second section 6 and positioned opposite of the first section 5, wherein the sponge 1 functions as the primary cleaning accessory within the present invention. The first section 5 is terminally and removably mounted to the rotor 18 opposite of the second section 6, wherein an attachment end of the first section 5 is formed to removably engaged with the rotor 18. More specifically, the attachment end of the first section 5 and the rotor 18 can utilize any type of attachment mechanism including, but is not limited to, a snap-fit attachment, a friction-fit attachment, and a male and female interlocking attachment. When the extension stem 4 is mounted to the rotor 18, the sponge 1 and the actuatable soap-dispensing mechanism 10 are in fluid communication with each other through the stem channel 7. More specifically, the pump-valve 13 is engaged with the stem channel 7 so that the pump-button 14 can selectively discharge a flow of soap from the soap receptacle 11 to the sponge 1 through the pump-valve 13 and the stem channel 7.

Figure 6:
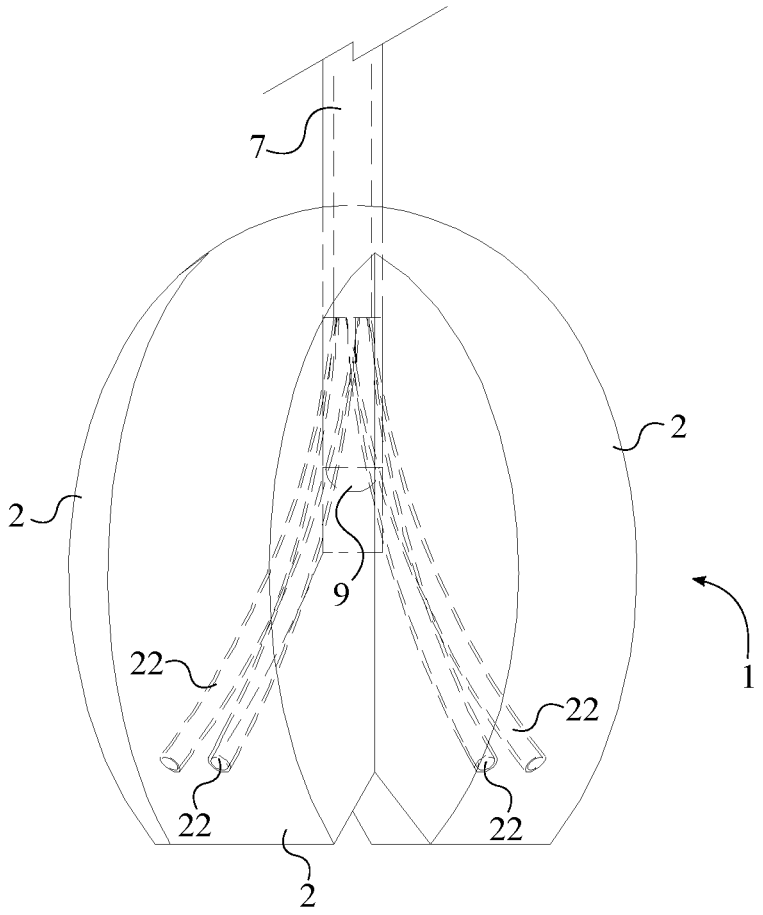
FIG. 6 is a detail view showing the plurality of flexible dispensing arms within the sponge of the present invention.

The present invention further comprises a plurality of flexible dispensing arms 22 so that a flow of soap can be evenly distributed to the sponge 1. In reference to FIG. 6, the plurality of flexible dispensing arms 22 traverses into the sponge 1 and is in fluid communication with the stem channel 7. Additionally, the flexibility of the plurality of flexible dispensing arms 22 allows the sponge 1 to function naturally without causing any limitations for the sponge 1. Since the plurality of flexible dispensing arms 22 is in fluid communication with the stem channel 7, a flow of soap from the stem channel 7 is equally distributed among each of the plurality of flexible dispensing arms 22 thus creating an equally distributed flow of soap within the sponge 1. In reference to FIG. 1 and FIG. 6, the sponge 1 comprises a plurality of segmented sections 2 that is radially distributed around the extension stem 4. Each of the plurality of flexible dispensing arms 22 is positioned within a corresponding section from the plurality of segmented sections 2 so that each of the plurality of segmented sections 2 can receive a flow of soap from the stem channel 7. The plurality of segmented sections 2 allows the sponge 1 to easily move in between different protrusions of the bottles or other dishes so that the present invention can maximize the cleaning process.

Figure 8:
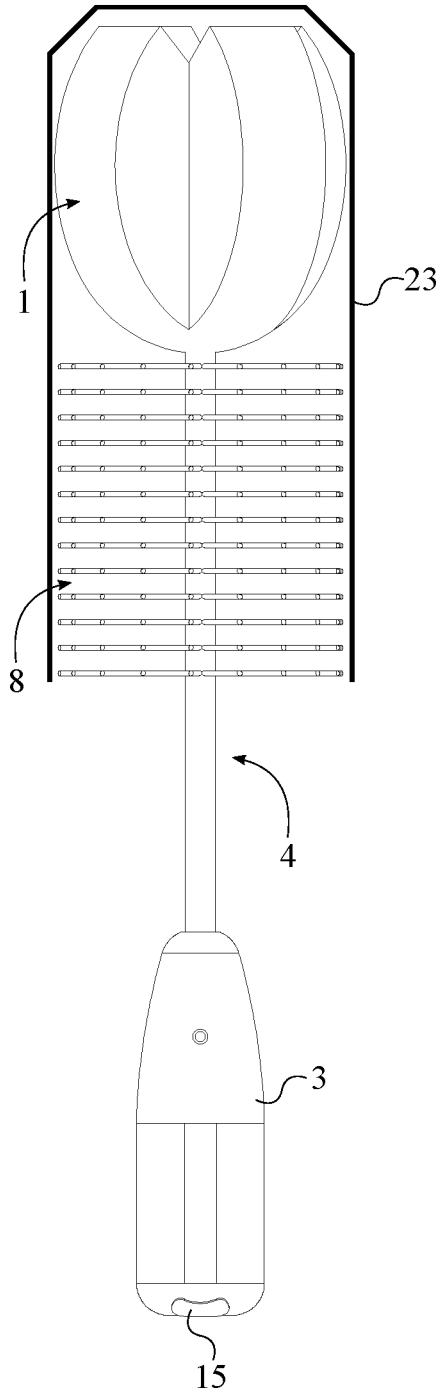
FIG. 8 is a side view of the present invention with the reflective lid.

The UV sterilizer light 9 that disinfects the sponge 1 and the plurality of bristles 8 as they generally tend to carry disease-causing bacteria, fungi, and food-borne pathogens after the initial usage. In reference to FIG. 4 and FIG. 9, the UV sterilizer light 9 is electrically connected to the charging interface 21, wherein the charging interface 21 directly powers the UV sterilizer light 9 while the rechargeable battery 19 is also re-charged. In order to efficiently utilizes the UV sterilizer light 9, the present invention further comprises a reflective lid 23 as shown in FIG. 8. More specifically, the sponge 1 and the plurality of bristles 8 are perimetrically enclosed by the reflective lid 23. As a result, the reflective lid 23 is able to maximize the disinfecting process as the UV light that emits the from UV sterilizer light 9 is fully captured within the reflective lid 23.

The users would use the present invention by first placing onto the charging station so that the rechargeable battery 19 can be re-charged. Once the present invention is fully charged, the users should remove the cap 15 and pour a quantity of soap into the soap receptacle 11, then attach the cap 15 back into the handle 3 to close the soap receptacle 11. The users can then proceed to push the pump-button 14 to discharge as much soap as desired towards the sponge 1. The present invention is then considered ready to use, and the users can proceed to clean bottles or other dishes while activating the motor 16 as desired via the power switch 20. After the bottle washing process is completed, the present invention should be placed back on the charging station to activate the UV sterilizer light 9 and to re-charge the rechargeable battery 19. The users would then place the reflective lid 23 over the sponge 1 and the plurality of bristles 8 to allow the UV sterilizer light 9 to fully disinfect the present invention.

The present invention is very useful for several reasons in comparison to existing bottle washing brushes. More specifically, the users who utilize currently available bottle brushes are unable to disinfect their bottle brushes. On the other hand, the present invention provides the UV sterilizer light 9 so that the users can simultaneously disinfect the present invention while the rechargeable battery 19 is charged through the charging station. The motorized brush that includes the extension stem 4, the plurality of bristles 8, the UV sterilizer light 9, the sponge 1, and the plurality of flexible dispensing arms 22 allows the present invention to effectively clean dishes while cleaning glasses and bottles quicker and more effective, reducing cleaning time, and reducing water consumption. Since the motorized brush is removably mounted to the handle 3 as shown in FIG. 7, the present invention allows the users to interchange different size and diameter motorized brushes with the handle 3 to accommodate different bottle sizes. The present invention also allows the users to clean bottles or other dishes with the motorized brush while protecting their hands from coming into contact with the disease-causing bacteria, food-borne pathogens, or soap particles that may present during the bottle washing process.

Although the invention has been explained in relation to its preferred embodiment, it is to be understood that many other possible modifications and variations can be made without departing from the spirit and scope of the invention as hereinafter claimed.

What is claimed is:

1. A multifunctional bottle washing brush comprises:
a sponge;
a handle;
an extension stem;
an ultraviolet (UV) sterilizer light;
an actuatable soap-dispensing mechanism;
a motor;
the sponge being terminally connected to the extension stem;
a stator of the motor being mounted within the handle;
the extension stem being terminally and removably mounted to a rotor of the motor;
the sponge and the handle being positioned opposite of each other along the extension stem;
the actuatable soap-dispensing mechanism being integrated into the handle;
the sponge and the actuatable soap-dispensing mechanism being in fluid communication with each other through the extension stem; and
the UV sterilizer light being mounted within the sponge.

2. The multifunctional bottle washing brush as claimed in claim 1 comprises:
a plurality of bristles;
the extension stem comprises a first section and a second section;
the first section and the second section being concentrically positioned adjacent to each other; and
the plurality of bristles being laterally connected along the second section.

3. The multifunctional bottle washing brush as claimed in claim 2, wherein the rotor being terminally mounted to the first section, opposite of the second section.

4. The multifunctional bottle washing brush as claimed in claim 2, wherein the sponge being terminally connected to the second section, opposite of the first section.

5. The multifunctional bottle washing brush as claimed in claim 1 comprises:
a stem channel;
the stem channel traverses through the extension stem; and
the sponge and the actuatable soap-dispensing mechanism being in fluid communication with each other through the stem channel.

6. The multifunctional bottle washing brush as claimed in claim 1 comprises:
the actuatable soap-dispensing mechanism comprises a soap receptacle, a pump-valve, and a pump-button;
the soap receptacle traverses into the handle;
the pump-valve being mounted within the handle;
the pump-button being integrated onto the handle;
the pump-button being operatively coupled with the pump-valve; and
the pump-valve being in fluid communication with the soap receptacle.

7. The multifunctional bottle washing brush as claimed in claim 6 comprises:
a cap; and
the cap being adjacently attached about an opening rim of the soap receptacle.

8. The multifunctional bottle washing brush as claimed in claim 1, wherein the soap compartment is transparent.

9. The multifunctional bottle washing brush as claimed in claim 1 comprises:
a rechargeable battery;
a power switch;
a charging interface;
the rechargeable battery being mounted within the handle;
the power switch being integrated onto the handle;
the charging interface being integrated onto the handle;
the rechargeable battery being electrically connected to the charging interface; and
the motor and the power switch being electrically connected to the rechargeable battery.

10. The multifunctional bottle washing brush as claimed in claim 1 comprises:
a charging interface; and
the UV sterilizer light being electrically connected to the charging interface.

11. The multifunctional bottle washing brush as claimed in claim 1 comprises:
a plurality of flexible dispensing arms;
the plurality of flexible dispensing arms traverses into the sponge; and the plurality of flexible dispensing arms being in fluid communication with a stem channel of the extension stem.

12. The multifunctional bottle washing brush as claimed in claim 11 comprises:

the sponge comprises a plurality of segmented sections;

the plurality of segmented sections being radially distributed around the extension stem; and each of the plurality of flexible dispensing arms being positioned within a corresponding section from the plurality of segmented sections.

13. The multifunctional bottle washing brush as claimed in claim 1 comprises:

a reflective lid;

a plurality of bristles; and the sponge and the plurality of bristles being perimetrically enclosed by the reflective lid.

* * * * *